US007296434B2

(12) United States Patent
Scroggs

(10) Patent No.: US 7,296,434 B2
(45) Date of Patent: Nov. 20, 2007

(54) COOLER

(76) Inventor: Donald T. Scroggs, 200 S. Banana River Dr. B-18, Merrit Island, FL (US) 32952

( * ) Notice: Subject to any disclaimer, the term of this patent is extended or adjusted under 35 U.S.C. 154(b) by 140 days.

(21) Appl. No.: 11/157,155

(22) Filed: Jun. 20, 2005

(65) Prior Publication Data

US 2006/0021376 A1 Feb. 2, 2006

Related U.S. Application Data

(60) Provisional application No. 60/581,906, filed on Jun. 22, 2004.

(51) Int. Cl.
*F25B 21/00* (2006.01)

(52) U.S. Cl. ..... 62/457.7; 62/530

(58) Field of Classification Search ..... 62/371, 62/457.5, 457.7, 530
See application file for complete search history.

(56) References Cited

U.S. PATENT DOCUMENTS 4,286,440 A 9/1981 Taylor
4,655,052 A 4/1987 Garcia
4,662,188 A 5/1987 Hullihan
5,230,450 A * 7/1993 Mahvi et al. ..... 224/153
5,257,509 A 11/1993 Harris
5,329,787 A * 7/1994 Friday ..... 62/389
5,509,279 A * 4/1996 Brown et al. ..... 62/457.5
6,116,045 A * 9/2000 Hodosh et al. ..... 62/457.4
6,698,230 B1 3/2004 Brusky

* cited by examiner

*Primary Examiner*—Melvin Jones
(74) *Attorney, Agent, or Firm*—Beusse Wolter Sanks Mora & Maire, P.A.

(57) ABSTRACT

A cooler comprising a first compartment defining an interior region and a portion of the first compartment extending into an interior region of a second compartment. The interior region of the second compartment carries a cooling material that cools the interior region thereof. Heat flow from the interior region of the first compartment into the interior region of the second compartment cools the interior region of the first compartment.

16 Claims, 4 Drawing Sheets

COOLER

This application claims the benefit of the provisional application filed on Jun. 22, 2004, assigned application No. 60/581,906 and entitled Cooler.

FIELD OF THE INVENTION

The present invention relates to an apparatus for cold storage of ice, drinks and food items.

BACKGROUND OF THE INVENTION

Portable enclosures for cold-temperature storage of ice, drinks and food items are well known. Referred to as "coolers", they are available in various shapes and sizes, most commonly circular or rectangular in cross section with capacities ranging from one gallon to 75 gallons. Certain embodiments further comprise wheels and/or handles for portability and transportability. Ice (e.g., "dry" ice, ice packs) in the cooler maintains the food and drinks at a sufficiently low temperature to preserve freshness and retard spoilage.

Certain coolers referred to as "water jugs" filled with a water and ice mixture maintain the drinking water at a refreshingly cool temperature. Generally cylindrical in shape, the water jug comprises insulated upstanding sidewalls and a base that cooperate to define an open interior region. An openable or removable lid provides access to the interior region. The ice and water within the open region are insulated from ambient temperature and thus maintained at a lower temperature. Drinking water is withdrawn from the water jug by opening a manually operated valve disposed proximate the base.

The water jug also protects its ice and water contents from environmental contaminants, as access to the interior region is not required to dispense the water. The potable water remains clean and cold. Therefore it is generally not advisable to store containered drinks (cans and bottles) or food items in the water jug cooler, as contaminants on a container surface may contaminate the potable water. The act of placing an item in or removing an item from the water jug by reaching one's hand into the water jug may also contaminate the water. Water jugs are therefore best suited for a single function of storing only water.

Ice chest type coolers also have a single function. Generally rectangular in cross section, the ice chest comprises insulated upstanding sidewalls and a base that cooperate to define an open interior region. Ice, food (e.g., packaged food items) and/or containered drink items to be maintained at a low temperature are stored within the interior region. The beverage containers and packaged food items are typically placed above and in contact with exposed ice. A hinged or removable cooler door permits access to the stored items. Because dirt and contaminants may be present on the beverage containers and food packages, the water formed by ice melting within the container is generally not considered potable. Although an ice chest may include a valved nozzle or a drain, such is intended for draining water from the ice chest, not for providing access to clean drinking water.

BRIEF SUMMARY OF THE INVENTION

According to one embodiment, the invention comprises a cooler further comprising a first enclosed volume having a first controllable opening to provide access to an interior region thereof, a second enclosed volume surrounding a portion of the first enclosed volume, the second enclosed volume having a second controllable opening to provide access to an interior region thereof and wherein a material within the second enclosed volume cools the first enclosed volume.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DESCRIPTION OF THE INVENTION

Figure 1:
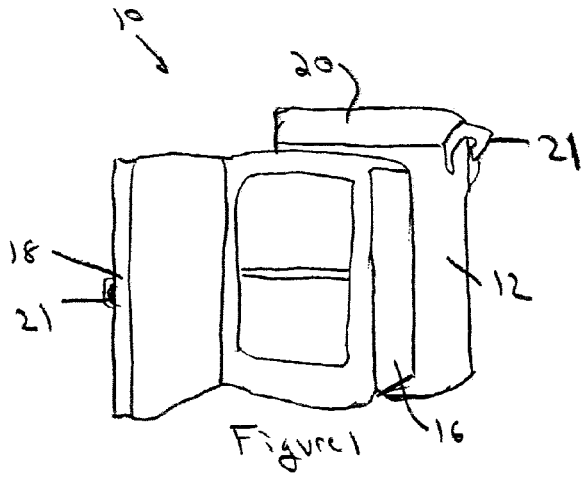
FIGS. 1 and 2 illustrate two configurations of a cooler of the present invention.

Before describing in detail the particular cooler in accordance with the present invention, it should be observed that the present invention resides primarily in a novel combination of elements. Accordingly, the elements have been represented by conventional elements in the drawings, showing only those specific details that are pertinent to the present invention, so as not to obscure the disclosure with structural details that will be readily apparent to those skilled in the art having the benefit of the description herein.

A cooler constructed according to the teachings of the present invention offers advantages of both the water jug and ice chest type prior art coolers, but avoids their disadvantages. As illustrated in the various views of FIGS. 1-3, a cooler 10 comprises an enclosed volume 12 (e.g., a cold water or water jug type storage enclosure) having an interior region in which is disposed a portion of an enclosed volume 16 (e.g., an ice chest type storage enclosure).

The enclosed volume 12 in one embodiment comprises a cooled vessel containing water and ice cubes (where "ice cubes" is intended to encompass any of the various known cooling elements, solids, or mechanisms, including ice rectangles, crescents, particles, chips, pieces, ice packs and "dry" ice and refrigerant-based mechanical cooling systems). The enclosed volume 16 in one embodiment stores packaged items, such as packaged food or drink containers that are desired to be kept in a relatively cool environment.

A wall 17 provides a physical barrier between the interior region of the enclosed volume 12 and the interior region of the enclosed volume 16 prevents physical contact between the contents of each. But since the interior regions are in a heat-exchange relationship, heat flows from the warmer enclosed volume to the colder enclosed volume to cool the contents of the former. Thus the coolant material or mechanism of the enclosed volume 12 cools the contents of the enclosed volume 16 as well as the contents of the enclosed volume 12. Specifically, the ice cubes and cold water within the enclosed volume 12 provide a cooling source for the packaged items stored within the enclosed volume 16, permitting the packaged items to be maintained at a cold temperature without requiring the use of ice within the enclosed volume 16. By avoiding the use of ice within the enclosed volume 16, an external surface of the packaged and containered items remains in a relatively dry condition.

Figure 2:
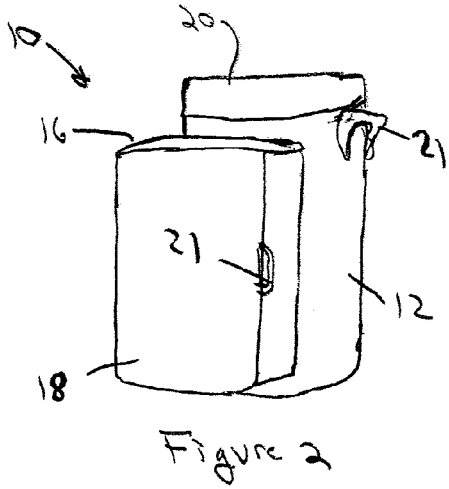

A door 18 pivotally affixed to the enclosed volume 16 is illustrated in an opened position in FIG. 1. In FIG. 2 the door 18 is illustrated in a closed position. The enclosed volume 12 comprises a removable lid 20. Preferably one or both of the enclosed volumes 12 and 16 comprises one or more handles 21 for transporting the cooler 10 and/or for controlling a position of the door 18 and/or the lid 20.

Figure 3:
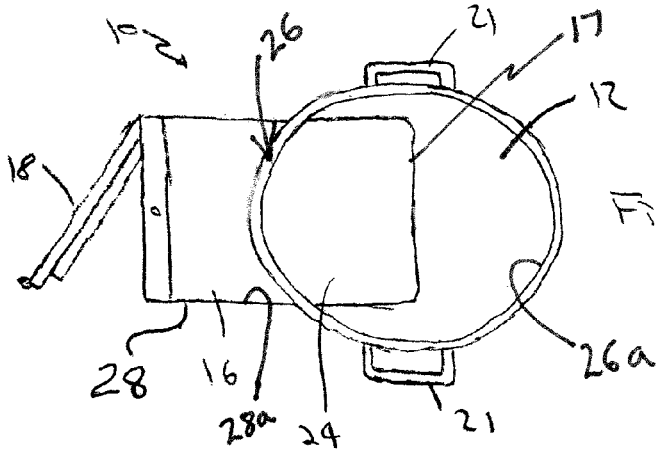
FIG. 3 illustrates a top view of the cooler of FIGS. 1 and 2.

Each of the enclosed volumes 12 and 16 comprises a plurality of insulated wall surfaces that provide a thermal barrier to the ambient atmosphere, which is generally warmer than the desired temperature of the interior region of the enclosed volumes 12 and 16. Specifically, as shown in FIG. 3, the volume 12 is defined in part by an interior surface 26*a* along an insulated wall section 26, and the volume 16 is defined in part by an interior surface 28*a* along an insulated wall section 28. As is known by those skilled in the art, the insulated wall surfaces can be constructed from various materials, including molded plastics. Typically each wall surface comprises an inner wall surface in parallel relationship with an outer wall surface, defining an interspace therebetween, wherein the interspace is preferably filled with an insulating material. The shape and size of the enclosed volumes 12 and 16 are not critical to the present invention.

As can also be seen clearly in the top view of FIG. 3 with the lid 20 removed, a portion 24 of the enclosed volume 16 extends into an interior region of the enclosed volume 12. In one embodiment, the wall surfaces of the enclosed volume 16 disposed within the interior region of the enclosed volume 12 are not insulated, as are the other wall surfaces, to maximize heat flow from the interior region of the enclosed volume 16 to the interior region of enclosed volume 12.

Thus the ice and water within the enclosed volume 12 provide cooling for the interior of the enclosed volume 16 and the beneficial effects of each cooler type are achieved. There is no melting ice within the enclosed volume 16 to soak or damage the packaged items stored there, and the cold water in the enclosed volume 12 is isolated from any contamination sources, permitting potable water to be dispensed from a valve, not shown in FIGS. 1-3, affixed to the enclosed volume 12.

Figure 4:
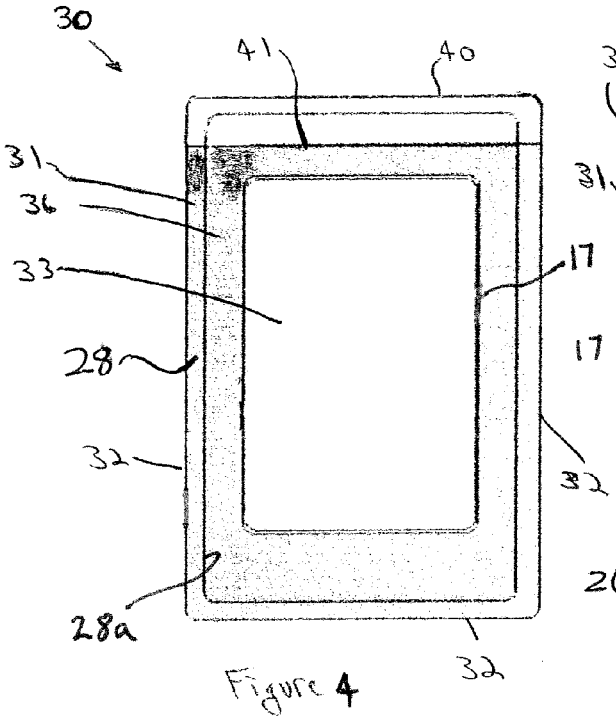
FIGS. 4 and 5 illustrate cross-sectional interior views of another embodiment of the present invention.
Figure 5:
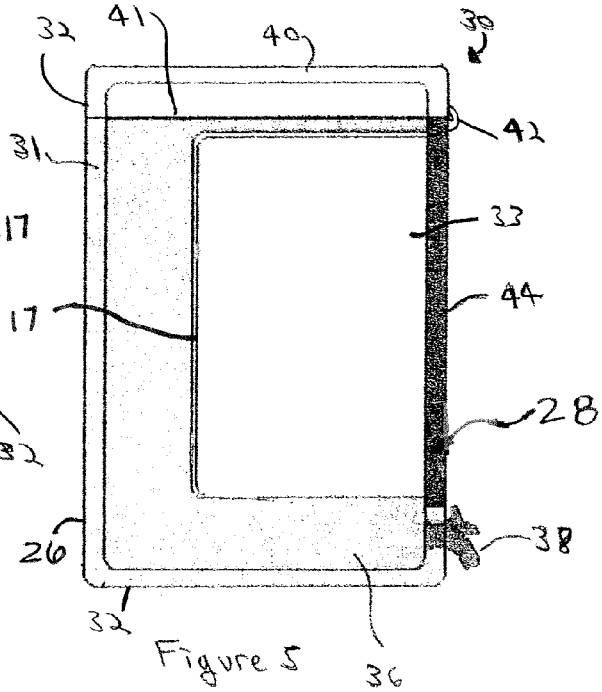

FIGS. 4 and 5 are cross-sectional interior views of another embodiment of a combination cooler 30 taken through a plane parallel to a front surface (FIG. 4) and through a plane parallel to a side surface (FIG. 5) of the combination cooler 30, respectively. The cooler 30 comprises an insulating material 31 within an enclosure defining external wall and base surfaces 32. Food and beverage items are stored in an interior region 33 defined by a wall 17 substantially surrounded by a water/ice storage region 36. Clean water is dispensed from the water/ice storage region 36 via a valve 38. The water/ice within the region 36 is physically separated from and therefore not contaminated by the food and beverage items stored within the interior region 33.

A lid 40 closes a top surface 41 of the combination cooler 30, providing access to the water/ice region 36 when removed. In one embodiment, the lid 40 is received by an annular ring within the top surface 39. In another embodiment a hinge 42 pivotally attaches the lid 40 to one of the wall surfaces 32.

Access to the interior region 33 is provided through a door 44 disposed in one of the wall surfaces 32. The door 44 may be hinged or otherwise removable according to known techniques. The door 44 is held in the closed position with a latch 45.

In one embodiment, an insulating layer 50 (not shown) may be included in the wall 17 between the interior region 33 and the water/ice storage region 36.

Figure 6:
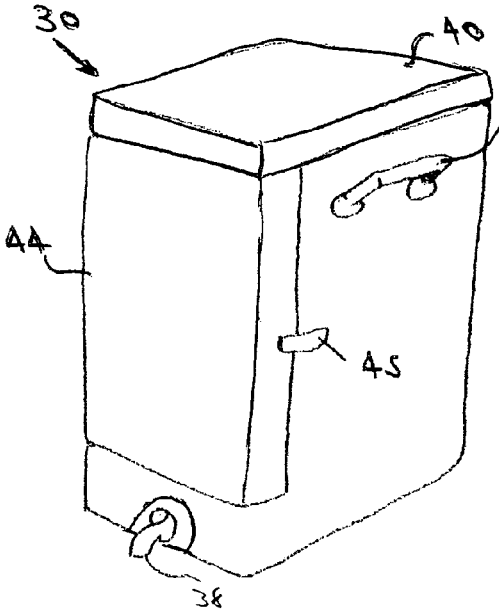
FIGS. 6-8 illustrate additional embodiments of the present invention.
Figure 7:
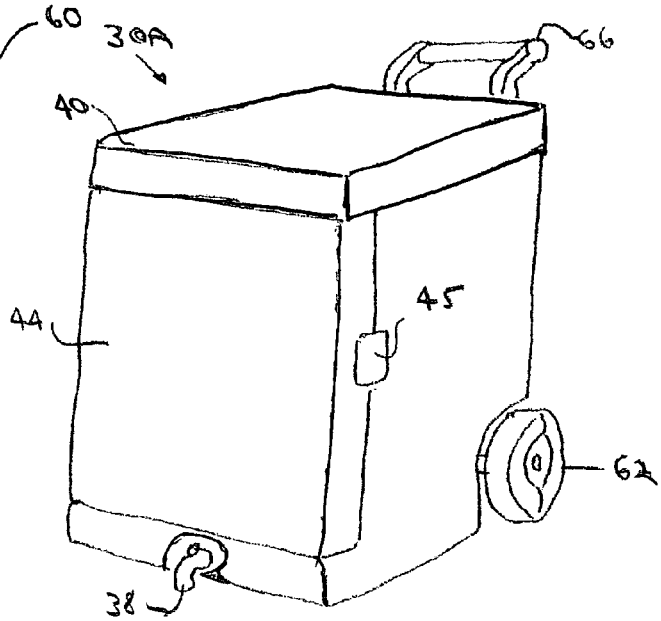
Figure 8:
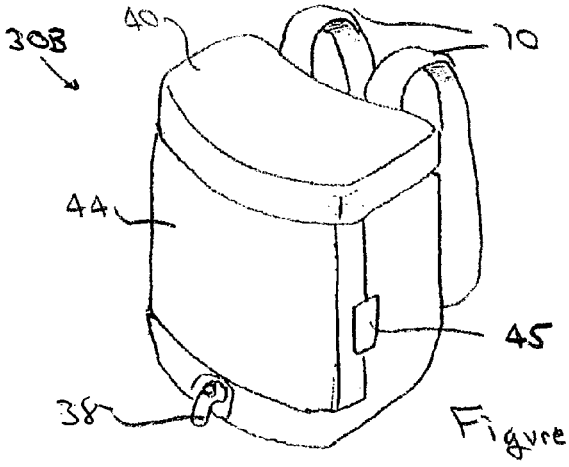

FIGS. 6-8 illustrate additional embodiments of the present invention, including an embodiment with handles 60 disposed on opposing side wall surfaces of the cooler 30, an embodiment 30A comprising wheels 62 and a handle 66, and an embodiment 30B comprising straps 70. These embodiments, which are merely illustrative, depict different structural features and transportation modes for the various cooler embodiments according to the present invention.

Figure 9:
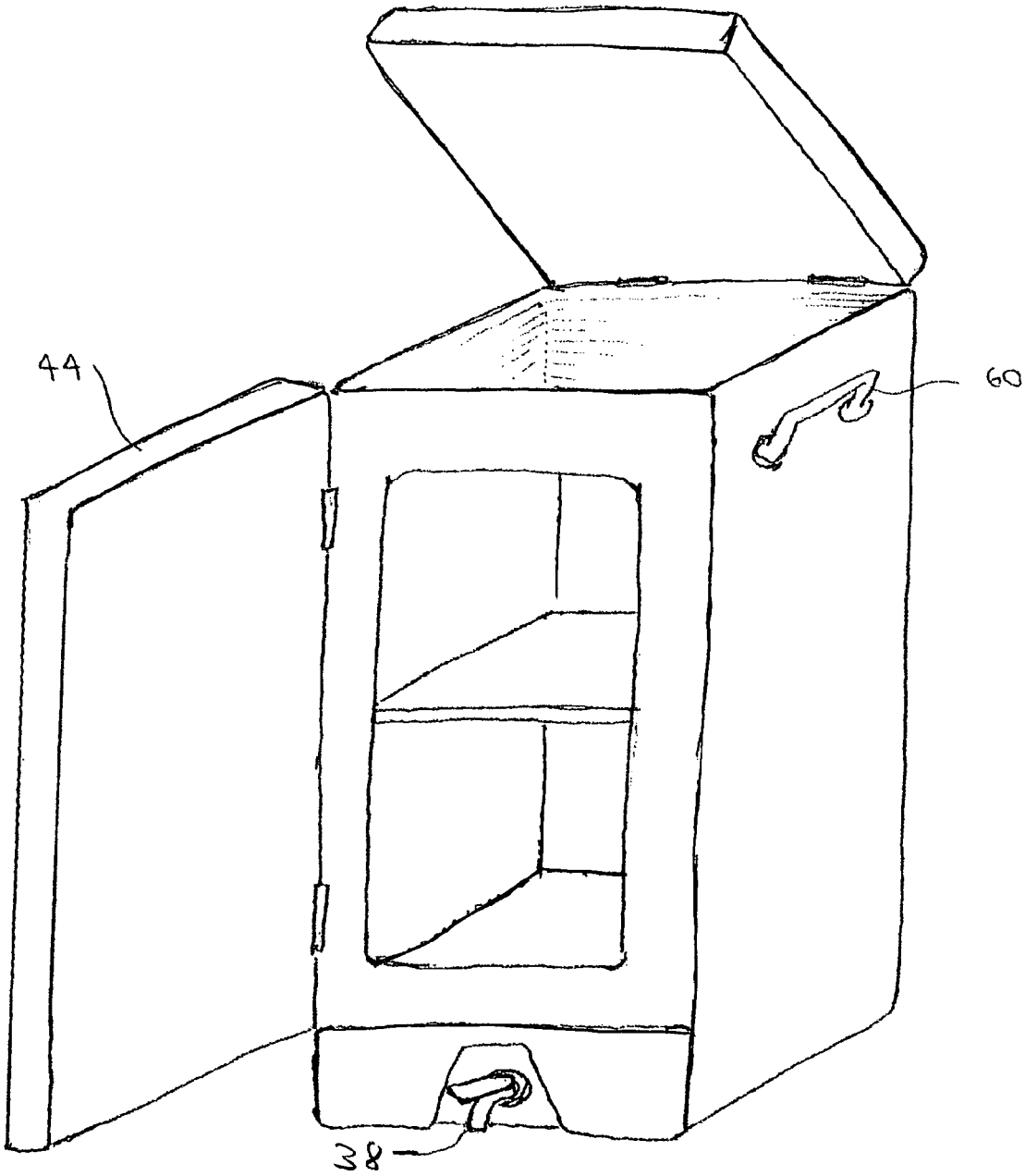
FIG. 9 illustrates a door-open configuration for the cooler embodiment of FIG. 6.

FIG. 9 illustrates the cooler 30 with the door 44 in the open position. The door 44 is attached to the cooler 30 with hinges 76 for pivotal displacement to expose the interior region 33.

As can be seen in the various presented embodiments of the combination cooler 30, the water/ice storage region surrounds the region 33, creating a "refrigerator like" cooling function for the packaged or containered items stored within the region 33.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope thereof For example, different sized and shaped components can be employed to form a cooler according to the teachings of the present invention. Therefore, it is intended that the invention not be limited to the particular embodiment disclosed as the best mode contemplated for carrying out this invention, but that the invention will include all embodiments falling within the scope of the appended claims.

What is claimed is:

1. A cooler comprising:

a first enclosure of a first shape including a first enclosed volume and including a first controllable opening to provide access to an interior region thereof;

a second enclosure of a second shape including a second enclosed volume partly defined by an insulated wall portion providing a thermal barrier relative to an ambient condition, the first and second shapes both defined in part with a wall portion common to each, a portion of the second volume extending about a portion of the first volume, so that the portion of the first volume is disposed within a region defined by the second shape, the second enclosure including a second controllable opening to provide access to an interior region thereof; and wherein the first and second enclosed volumes are separated from one another by a single wall common to each through which the first and second enclosed volumes are in a heat exchange relationship so that when a cooling material is placed within the second enclosed volume the first enclosed volume is cooled by heat exchange through the single common wall.

2. The cooler of claim 1 wherein the cooling material may be taken from the group including ice, dry ice and water.

3. The cooler of claim 2 wherein the second enclosed volume is connected to a valve for dispensing a liquid from the second enclosed volume.

4. The cooler of claim 1 wherein external surfaces defining the first enclosed volume bounds the interior region thereof, and wherein one external surface defines the first controllable opening, and wherein a closure structure received within the first controllable opening has a first position for providing access to the interior region and a second position for closing the first controllable opening.

5. The cooler of claim 1 wherein external surfaces defining the second enclosed volume bound the interior region thereof, and wherein one external surface defines the second controllable opening, and wherein a closure structure received within the second controllable opening has a first position for providing access to the interior region and a second position for closing the second controllable opening.

6. An insulated structure comprising:

first wall surfaces cooperating to define a first interior region, wherein one of the first wall surfaces defines a first closable opening therein through which access is gained to the first interior region; and insulated second wall surfaces cooperating to define a second interior region, wherein at least a portion of the first interior region extends into the second interior region, and wherein one of the insulated second wall surfaces defines a second closable opening therein through which access is gained to the second interior region, and wherein the first and second interior regions are separated from one another by a single wall common to each through which the first and second interior regions are in a heat exchange relationship so that when a cooling agent is placed within the second enclosed volume the first enclosed volume is cooled by heat exchange through the single common wall.

7. The insulated structure of claim 6 wherein the cooling agent comprises ice cubes and the contents of the second interior region may comprise water.

8. The insulated structure of claim 7 further comprising a valve for dispensing water from the second interior region.

9. An insulated structure comprising first surfaces cooperating to define a first closed interior region, wherein a side surface of the first surfaces defines a first closable opening providing access to the first closed interior region; and second insulated surfaces cooperating to define a second closed interior region, wherein the first closed interior region is disposed wholly within the second closed interior region, and wherein an externally disposed upper surface of the second insulated surfaces defines a second closable opening providing access to the second closed interior region, and wherein, when the second interior region carries a cooling agent, heat is drawn from the first interior region.

10. The insulated structure of claim 9 wherein the cooling agent comprises ice cubes.

11. The insulated structure of claim 10 further comprising a valve for dispensing water from the second interior region.

12. An insulated structure comprising:

a first closed volume defined by a first container including a first closable opening providing access to the first closed volume; and a second closed volume positioned along the first closed volume and separated from the first closed volume by a single wall having first and second opposing surfaces, the first wall surface providing an interior wall of the first closed volume and the second wall surface providing an interior wall of the second closed volume, wherein the second closed volume is defined by a second container including the second wall surface and a second closable opening providing access to the second closed volume, and wherein, when a cooling agent is present in, or acts on, the second closed volume, heat can be withdrawn from the first closed volume by a heat transfer through the wall.

13. The insulated structure of claim 12 wherein the second closed volume has a shape defined by a combination comprising said single wall and an insulated wall surface, and a portion of the first closed volume is positioned within the shape of the second closed volume.

14. The insulated structure of claim 12 wherein the cooling agent comprises ice cubes.

15. The insulated structure of claim 14 further comprising a valve for dispensing a liquid from the second closed volume.

16. The structure of claim 6 wherein the single wall common to the first and second interior regions includes at least some of the first surfaces.

* * * * *